US006364785B1

(12) United States Patent
Chen

(10) Patent No.: US 6,364,785 B1
(45) Date of Patent: Apr. 2, 2002

(54) GOLF TRAINING DEVICE

(76) Inventor: I-Ming Chen, No. 60, Lane 328, Li-Shan St., Nei-Hu Dist., Taipei City (TW)

( * ) Notice: Subject to any disclaimer, the term of this patent is extended or adjusted under 35 U.S.C. 154(b) by 0 days.

(21) Appl. No.: 09/611,816

(22) Filed: Jul. 7, 2000

(30) Foreign Application Priority Data

Mar. 29, 2000 (TW) ..... 89205055 U

(51) Int. Cl.[7] ..... A63B 57/00; A63B 69/36

(52) U.S. Cl. ..... 473/222; 473/221; 473/220; 473/223

(58) Field of Search ..... D21/319, 358, D21/709, 790, 791; 273/317.2, 354; 473/159, 173, 174, 175, 176, 177, 178, 180, 181, 182, 183, 190, 191, 192, 193, 198, 199, 200, 220, 222, 223, 225, 238, 251

(56) References Cited

U.S. PATENT DOCUMENTS 4,563,009 A * 1/1986 Nagasaki et al. ..... 273/173 R
5,169,150 A * 12/1992 Tindale ..... 273/187.4
5,242,169 A * 9/1993 Laabs ..... 273/179
5,330,188 A * 7/1994 Reimers ..... 273/186.1
5,464,221 A * 11/1995 Carney ..... 273/186.3
5,725,439 A * 3/1998 Halsey et al. ..... 473/220
5,810,674 A * 9/1998 Falossi et al. ..... 473/220
5,839,969 A * 11/1998 Klouda ..... 473/220
6,139,442 A * 10/2000 Wilson ..... 473/220

* cited by examiner

*Primary Examiner*—Mark S. Graham
*Assistant Examiner*—Alvin A Hunter, Jr.
(74) *Attorney, Agent, or Firm*—Christensen O'Connor Johnson Kindness PLLC

(57) ABSTRACT

A golf training device includes a golf club, a ball receiving socket, a light emitter, and a light beam receiver. The golf club includes a golf head with a front striking face. The golf ball receiving socket has a slot adapted to receive a golf ball that was struck by the golf head. The light emitter is mounted on the golf head and is aligned vertically with the center of the front striking face for emitting a light beam substantially parallel to a line passing through the center of the front striking face and perpendicular to the front striking face. The light beam receiver is mounted on the ball receiving socket in the vicinity of the slot for receiving the light beam and for generating a signal when the slot is in alignment with the light beam.

3 Claims, 6 Drawing Sheets

GOLF TRAINING DEVICE

BACKGROUND OF THE INVENTION

1. Field of the Invention

This invention relates to a golf training device, more particularly to a golf training device that includes a golf club with a light emitter provided thereon, and a ball receiving socket with a light beam receiver provided thereon.

2. Description of the Related Art

A conventional golf training device, particularly used for short distance shot and indoor practice, normally includes a golf club and a ball receiving socket. However, such training device does not provide any means that can offer the user to analyze his/her swing techniques and to be able to develop his/her skill to correctly and accurately strike a golf ball.

SUMMARY OF THE INVENTION

Therefore, the object of the present invention is to provide a golf training device that provides means for enabling the user to analyze his/her swing technique in order to develop his/her skill to correctly and accurately strike a golf ball.

In accordance with one aspect of the present invention, a golf training device comprises: a golf club including a golf head with a front striking face having a center; a ball receiving socket to be placed at a location spaced apart from the golf head and having a slot adapted to receive a golf ball that was struck by the golf head; a rail which has one end connected to the slot and which extends downwardly and then inclinedly from that one end of the rail; a ball releasing unit disposed at another end of the rail which is lower than that one end of the rail; an exit hole disposed above the ball releasing unit; a cover movably closing the exit hole; a motor mounted below another end of the rail to drive the ball releasing unit; a control circuit unit connected to the motor; and, a first actuator connected to the control circuit unit disposed adjacent another end of the rail to actuate the control circuit unit when the golf ball reaches and touches the first actuator; the ball releasing unit being movable upward to reach the cover and downward to be disposed below another end of the rail; the ball receiving socket further having a top wall formed with the exit hole, and a sloped sidewall extending downwardly and inclinedly from the top wall adjacent the exit hole; a light emitter mounted on the golf head and aligned substantially vertically with the center of the front striking face for emitting a light beam substantially parallel to a line passing through the center of the front striking face and perpendicular to the front striking face; and a light beam receiver mounted on the ball receiving socket in the vicinity of the slot for receiving the light beam and for generating a signal when the slot is in alignment with the light beam.

BRIEF DESCRIPTION OF THE DRAWINGS

In drawings which illustrate an embodiment of the invention.

DETAILED DESCRIPTION OF THE PREFERRED EMBODIMENT

Figure 1:
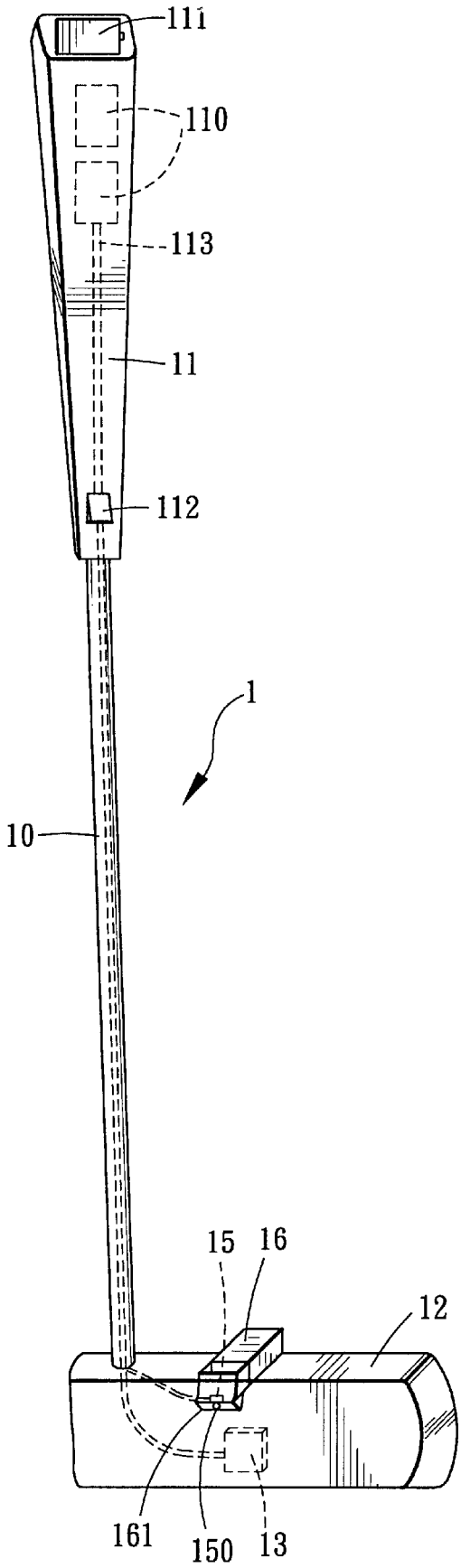
FIG. 1 is a rear perspective view of a golf club of a golf training device embodying this invention.
Figure 2:
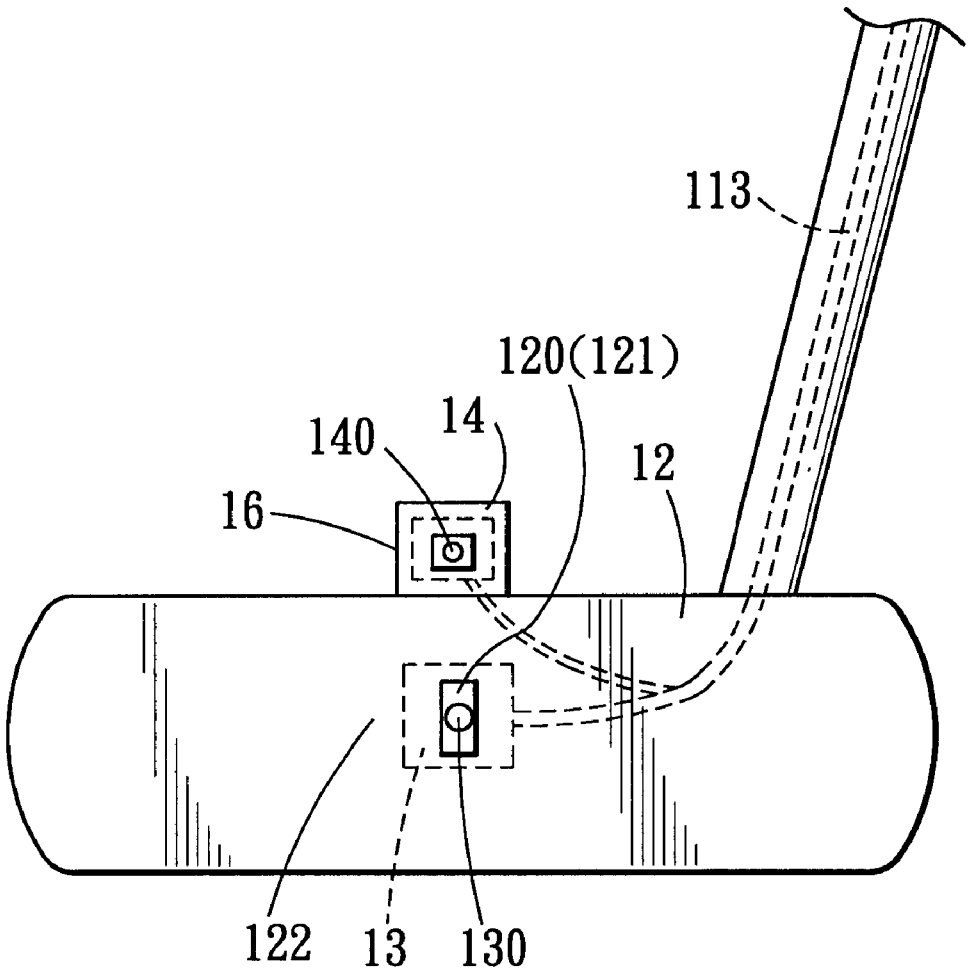
FIG. 2 is a fragmentary front view of the golf club of FIG. 1.
Figure 3:
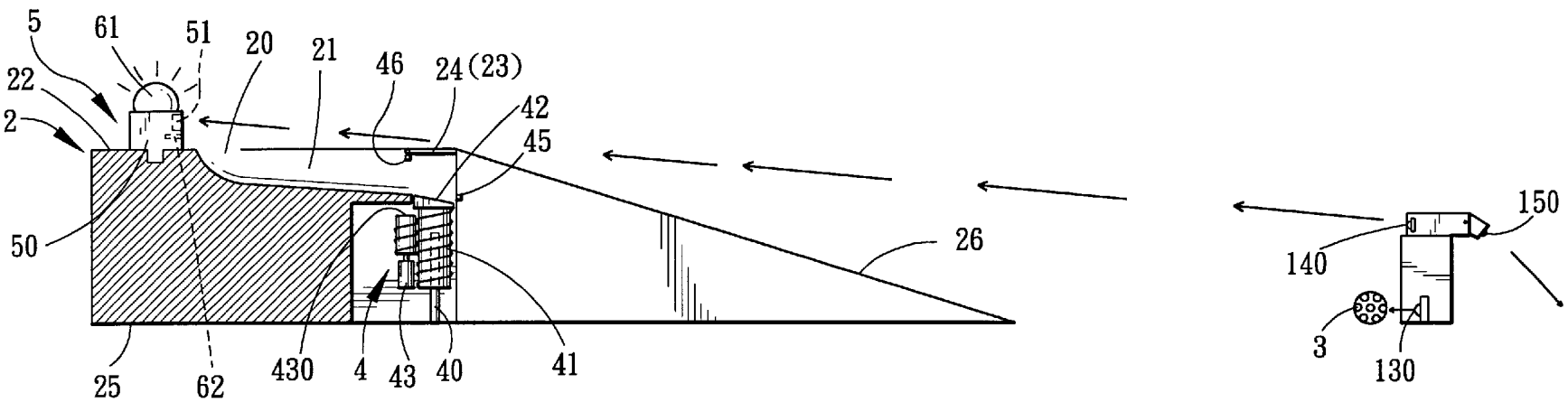
FIG. 3 is a schematic side view of the golf club of FIG. 1 aligned with a ball receiving socket.
Figure 4:
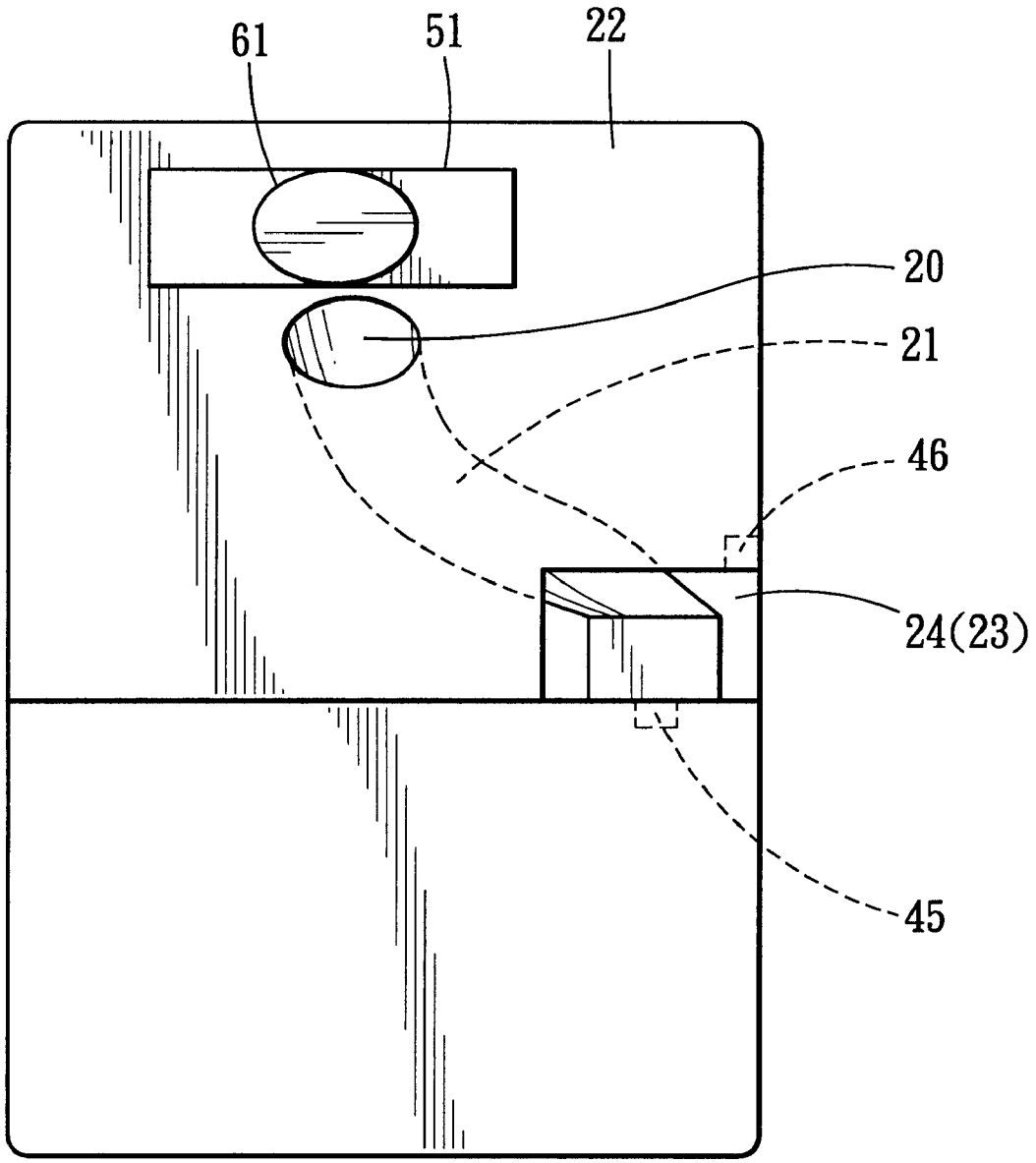
FIG. 4 is a schematic top view of the golf ball receiving socket of FIG. 3.
Figure 5:
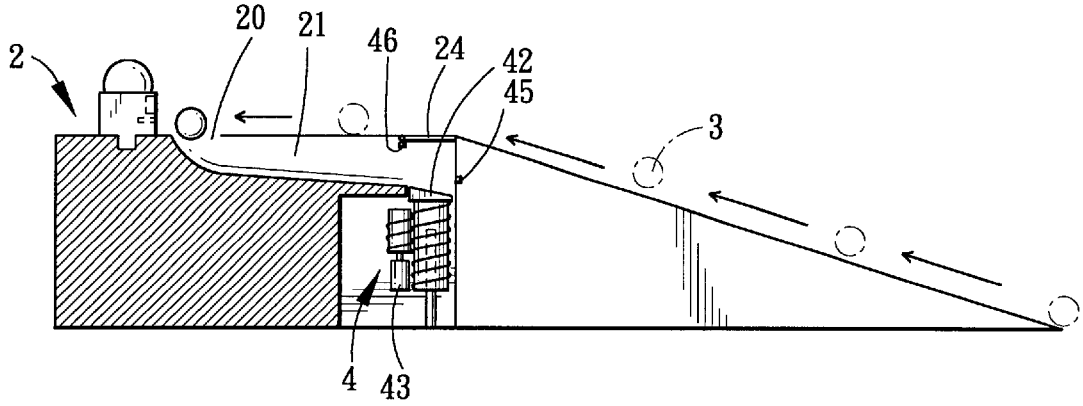
FIGS. 5 and 6 are a side views to illustrate how a golf ball is received by the golf ball receiving socket of FIG. 3.
Figure 6:
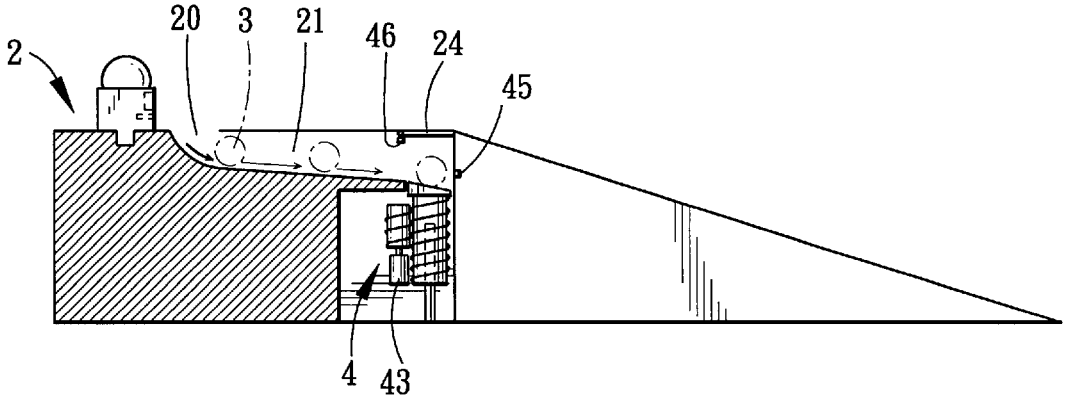
Figure 7:
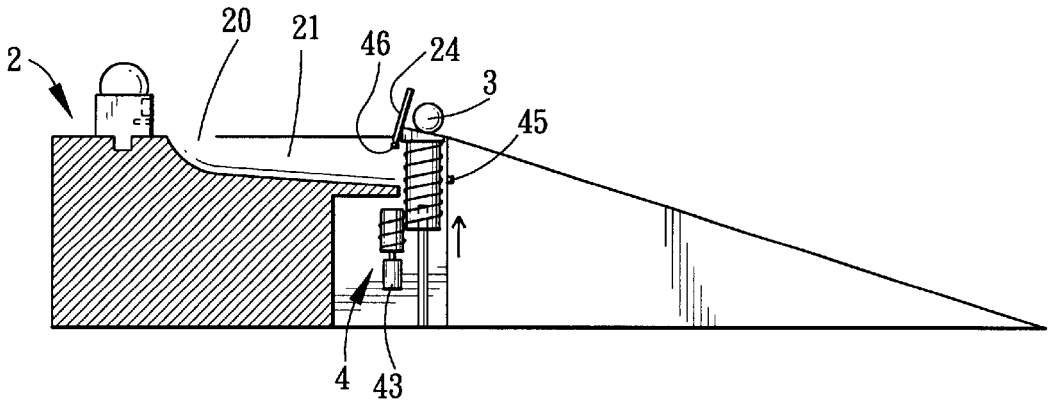
FIGS. 7 and 8 are a side views to illustrate how the golf ball being is ejected by the golf ball receiving socket of FIG. 3.
Figure 8:
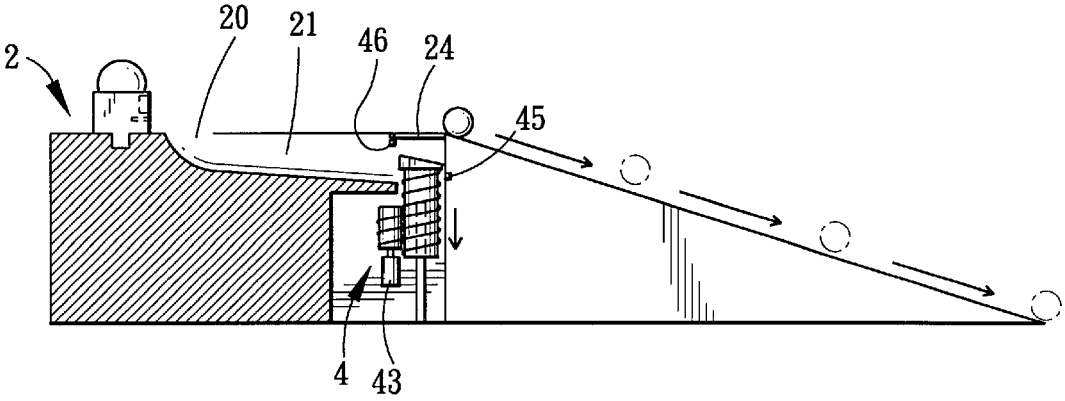

FIGS. 1 and 4 illustrate a golf training device embodying this invention. The golf training device includes a golf club 1, a ball receiving socket 2, a first light emitter 14, a second light emitter 13, a third light emitter 15, a light beam receiver 5, and a power supply unit 110. The first, second, and third light emitters 14, 13, 15 respectively include first, second, and third laser diodes 140, 130, 150 which are connected to the power supply unit 110 via electrical wiring 113 for producing first, second, and third laser beams.

The golf club 1 includes a golf shaft 10, a grip 11 connected to a top end of the golf shaft 10, and a golf head 12 opposite to the grip 11 and connected to a bottom end of the golf shaft 10. A receiving space is formed in the grip 11 for receiving the power supply unit 110, which is preferably a battery set in the embodiment. The grip 11 has a grip opening formed at the top end thereof with a first cover 111 covering thereon. An ON/OFF switch 112 is mounted on a lower side of the grip 11, and is connected to the power supply unit 110 via the electrical wiring 113.

The golf head 12 has a front striking face 122 that has a center and that is formed with a head opening 120 at the center of the front striking face. The head opening 120 is covered by a transparent protection piece 121. The second light emitter 13 is mounted in the golf head 12 at the center of the front striking face 122, and serves as an indicator that indicates the location of the center of the striking face so that alignment of a golf ball 3, which is placed in front of the front striking face 122, with the center of the front striking face 122 can be assured. The head opening 120 is aligned horizontally with the second laser diode 130 for passage of the second laser beam.

A horizontally extending support body 16 is mounted on a top end of the golf head 12, and has a front end opening substantially flush with the front striking face 122 of the golf head 12. The first light emitter 14 is mounted in the support body 16, and is aligned vertically with the second light emitter 13 such that the first laser beam is parallel to a line passing through the center of the front striking face 122 and is perpendicular to the front striking face 122. The front end opening of the support body 16 is aligned horizontally with the first laser diode 140 for passage of the first laser beam.

A rotatable part 161 is mounted rotatably on a rear end of the support 16, and has a rear end opening that opens downwardly. The third light emitter 15 is mounted in the rotatable part 161, and faces downwardly. The rear end opening of the rotatable part 161 is aligned with the third laser diode 150 for passage of the third laser beam. The rotatable part 161 is rotatable relative to the support body 16 such that the third laser beam can be directed to the ground at different angles.

The golf ball receiving socket 2 is to be placed at a location spaced apart from the golf club 1, and has a horizontally extending top wall 22, a bottom wall 25 opposite to the top wall 22, a sloped side wall 26 facing the golf club 1 and extending inclinedly and downwardly from one end of the top wall 22 to one end of the bottom wall 25, a slot 20 formed in the top wall 22 for receiving the golf ball 3 that was struck by the golf head 12, an exit hole 23 formed in the top wall 22 adjacent to said one end of the top wall 22 for passage of the golf ball 3, a second cover 24 movably closing the exit hole 23, a rail 21 which is formed therein between the slot 20 and the exit hole 23, which has one end connected to the slot 20, and which slopes downwardly and gradually from the slot 20 to a position substantially aligned with the second cover 24.

Referring now to FIGS. 5 to 9, in combination with FIGS. 1 to 4, a ball releasing unit 4 is mounted in the golf ball receiving socket 2 adjacent to the other end of the rail 21. The golf ball releasing unit 4 includes a vertical rotary shaft 40 aligned with the exit hole 23 and projecting from the bottom wall 25 to the other end of the rail 21, a screw driven member 41 sleeved around the rotary shaft 40 and provided with a seat 42 at a top end thereof, and a screw driving member 430 driven by a motor 43 and engaging the screw driven member 41 for moving the screw driven member 41 upward and downward along the rotary shaft 40 between a first position, in which the seat 42 is positioned at the other end of the rail 21 for receiving the golf ball 3 from the slot 20 via the rail 21 (see FIGS. 5 and 6), and a second position, in which the seat 42 is positioned at the exit hole 23 for ejecting the golf ball 3 out of the rail 21 via the exit hole 23 (see FIGS. 7 and 8) A control circuit unit (not shown) is connected to the motor 43. First and second actuators 45, 46, which are preferably in the form of micro-switches, are mounted on the golf ball receiving socket 2 adjacent to the other end of the rail 21 and the exit hole 23, respectively, and are connected to the control circuit unit for actuating the control circuit unit to control the motor 43 when the golf ball 3 reaches and touches the first actuator 45 or when the seat 42 reaches the exit hole 23 and the second cover 24 touches the second actuator 46.

The light beam receiver 5 is mounted detachably on the top wall 22 of the golf ball receiving socket 2 in the vicinity of the slot 20 for receiving the first laser beam and for generating a signal when the first laser beam is aligned with the slot 20 upon striking the golf ball 3. The alignment of the slot 20 with the front end opening of the support body 16 gives an indication that the center of the front striking face 122 is substantially aligned with the center of the golf ball 3. The position of reflection of the second laser beam on the golf ball 3 can also be utilized to determine whether or not the center of the front striking face 122 is aligned with the center of the golf ball 3. The aforesaid signal can be generated by a lamp 61, a buzzer 62 or both.

With the arrangement of the third light emitter 15, the trajectory of the third laser beam reflected on the ground can be analyzed to determine whether or not the swinging of the golf club 1 is deflected.

With the invention thus explained, it is apparent that various modifications and variations can be made without departing from the spirit of the present invention. It is therefore intended that the invention be limited only as recited in the appended claims.

I claim:

1. A golf training device comprising:

a golf club including a golf head with a front striking face having a center;

a ball receiving socket to be placed at a location spaced apart from said golf head and having a slot adapted to receive a golf ball that was struck by said golf head;

a rail which has one end connected to said slot and which extends downwardly and inclinedly from said one end of said rail;

a ball releasing unit disposed at another end of said rail which is lower than said one end of said rail;

an exit hole disposed above said ball releasing unit;

a cover movably closing said exit hole;

a motor mounted below said another end of said rail to drive said ball releasing unit;

a control circuit unit connected to said motor;

a first actuator connected to said control circuit unit and disposed adjacent to said another end of said rail to actuate said control circuit unit when the golf ball reaches and touches said first actuator; and, a second actuator connected to said control circuit unit and disposed adjacent to said cover;

said ball releasing unit being movable upward to reach said cover and downward to be disposed below said another end of said rail and having a vertical rotary shaft mounted on said ball receiving socket and a screw member mounted on said shaft and connected to said motor, said shaft being turnable in two opposite directions by said motor, said second actuator actuating said control circuit unit when said ball releasing unit reaches said cover;

a light emitter mounted on said golf head and aligned substantially vertically with the center of said front striking face for emitting a light beam substantially parallel to a line passing through the center of said front striking face and perpendicular to said front striking face; and a light beam receiver mounted on said ball receiving socket in the vicinity of said slot for receiving said light beam and for generating a signal when said slot is in alignment with said light beam.

2. A golf training device comprising:

a golf club including a golf head with a front striking face having a center;

a ball receiving socket to be placed at a location spaced apart from said golf head and having a slot adapted to receive a golf ball that was struck by said golf head;

a rail which has one end connected to said slot and which extends downwardly and inclinedly from said one end of said rail;

a ball releasing unit disposed at another end of said rail which is lower than said one end of said rail;

an exit hole disposed above said ball releasing unit;

a cover movably closing said exit hole;

a motor mounted below said another end of said rail to drive said ball releasing unit;

a control circuit unit connected to said motor;

a first actuator connected to said control circuit unit and disposed adjacent to said another end of said rail to actuate said control circuit unit when the golf ball reaches and touches said first actuator; and, a second actuator connected to said control circuit unit and disposed adjacent to said cover;

said ball releasing unit being movable upward to reach said cover and downward to be disposed below said another end of said rail, said second actuator actuating said control circuit unit when said ball releasing unit reaches said cover;

said first and second actuators being micro-switches;

a light emitter mounted on said golf head and aligned substantially vertically with the center of said front striking face for emitting a light beam substantially parallel to a line passing through the center of said front striking face and perpendicular to said front striking face; and a light beam receiver mounted on said ball receiving socket in the vicinity of said slot for receiving said light beam and for generating a signal when said slot is in alignment with said light beam.

3. A golf training device comprising:

a golf club including a golf head with a front striking face having a center;

a ball receiving socket to be placed at a location spaced apart from said golf head and having a slot adapted to receive a golf ball that was struck by said golf head;

a rail which has one end connected to said slot and which extends downwardly and inclinedly from said one end of said rail;

a ball releasing unit disposed at another end of said rail which is lower than said one end of said rail;

an exit hole disposed above said ball releasing unit;

a cover movably closing said exit hole;

a motor mounted below said another end of said rail to drive said ball releasing unit;

a control circuit unit connected to said motor; and, a first actuator connected to said control circuit unit and disposed adjacent to said another end of said rail to actuate said control circuit unit when the golf ball reaches and touches said first actuator;

said ball releasing unit being movable upward to reach said cover and downward to be disposed below said another end of said rail;

said ball receiving socket further having a top wall formed with said exit hole, and a sloped side wall extending downwardly and inclinedly from said top wall adjacent to said exit hole;

a light emitter mounted on said golf head and aligned substantially vertically with the center of said front striking face for emitting a light beam substantially parallel to a line passing through the center of said front striking face and perpendicular to said front striking face; and a light beam receiver mounted on said ball receiving socket in the vicinity of said slot for receiving said light beam and for generating a signal when said slot is in alignment with said light beam.

* * * * *